United States Patent [19]

Turrentine

[11] 4,178,869

[45] Dec. 18, 1979

[54] COMBINED REMOVABLE TILLER EXTENSION HOLDING AND CONTROLLING DEVICE FOR WATERCRAFT

[76] Inventor: Fred C. Turrentine, 14201 SE. Parmenter, Milwaukie, Oreg. 97222

[21] Appl. No.: 900,348

[22] Filed: Apr. 27, 1978

[51] Int. Cl.[2] ..... B63H 25/52

[52] U.S. Cl. ..... 114/172; 74/495; 403/108; 403/118

[58] Field of Search ..... 114/144 R, 172, 146, 114/162, 230; 115/18 R; 403/118, 108, 60; 280/92; 74/532, 495

[56] References Cited

U.S. PATENT DOCUMENTS

| | | | |
|---|---|---|---|
| 2,846,896 | 8/1958 | Allen | 114/172 X |
| 3,064,615 | 11/1962 | Waltman | 114/230 |
| 3,177,838 | 4/1965 | Grimes | 114/230 |
| 3,279,410 | 10/1966 | Young | 114/172 |
| 3,712,652 | 1/1973 | Wilkema | 403/108 |

*Primary Examiner*—Stephen G. Kunin
*Assistant Examiner*—Sherman D. Basinger
*Attorney, Agent, or Firm*—W. Britton Moore

[57] ABSTRACT

A combined tiller extension, holding and controlling device for watercraft embodying an elongated tubular member removably attached at opposing ends to a vessel coaming and tiller, and including spring loaded telescoping and detent retained sections whereby the tiller is extensibly operable and is retained on a predetermined course, but permitting of limited lateral deviations therefrom. In addition, manual rotational control of the tubular sections enables finer course rudder adjustment within such a course.

6 Claims, 5 Drawing Figures

COMBINED REMOVABLE TILLER EXTENSION HOLDING AND CONTROLLING DEVICE FOR WATERCRAFT

The present invention relates to a combined tiller extension, holding and controlling device for watercraft.

While many tiller attachments for the tillers of watercraft have heretofore been proposed, such as those represented by U.S. patents to Frostad U.S. Pat. Nos. 453,338, Higgins et al 983,715, Bailey 1,679,395, and Vidach 3,221,699, none thereof have been so arrangeable and removably connectable to a tiller and cockpit coaming so that the rudder and craft may be held on a predetermined course, and yet automatically permitted of limited lateral deviations therefrom, while still permitting of manual rotational control thereof to enable finer course rudder control.

The principal object of the present invention is to provide a combined tiller extension, holding and controlling device for removable attachment at opposing ends to a watercraft tiller and cockpit coaming.

Another object is the provision of an elongated tubular member removably attacheable at opposing ends to vessel coaming and tiller, and including spring loaded telescoping and detent retained sections enabling combined extensible operation of the tiller and retention thereof on a predetermined course. While still permitting of limited lateral deviations therefrom, and manual rotational control to effect finer course rudder control or adjustment.

Still another object is to provide of an elongated tubular member having pivotal pins at opposing ends removably interconnected with sockets in a vessel tiller and coaming to enable one or both ends being disconnected to permit of normal operation of the tiller, or use as a tiller extension.

A further object is the provision of an elongated tubular member interposed between and removably interconnected to a vessel coaming and tiller and which functions as a tiller holding and retaining device and provides precise and speedy tiller adjustments to effectively steer a sailing boat and the like without the necessity of constantly holding the tiller.

These and other objects and advantages will be apparent as the specification is considered with the accompanying drawings, wherein FIG. 1 is a perspective view of the tiller holding and controlling device in assembled position in the cockpit of a sail boat;

Figure 1:
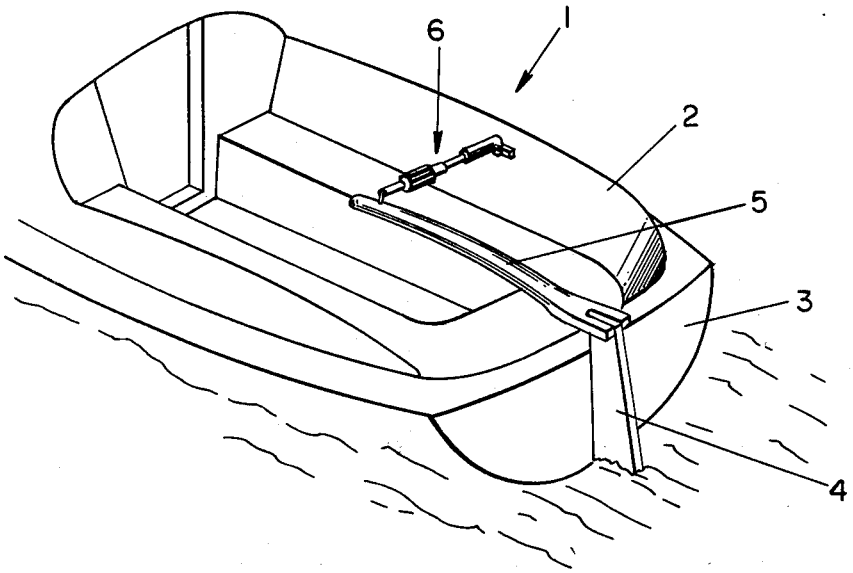
Figure 2:
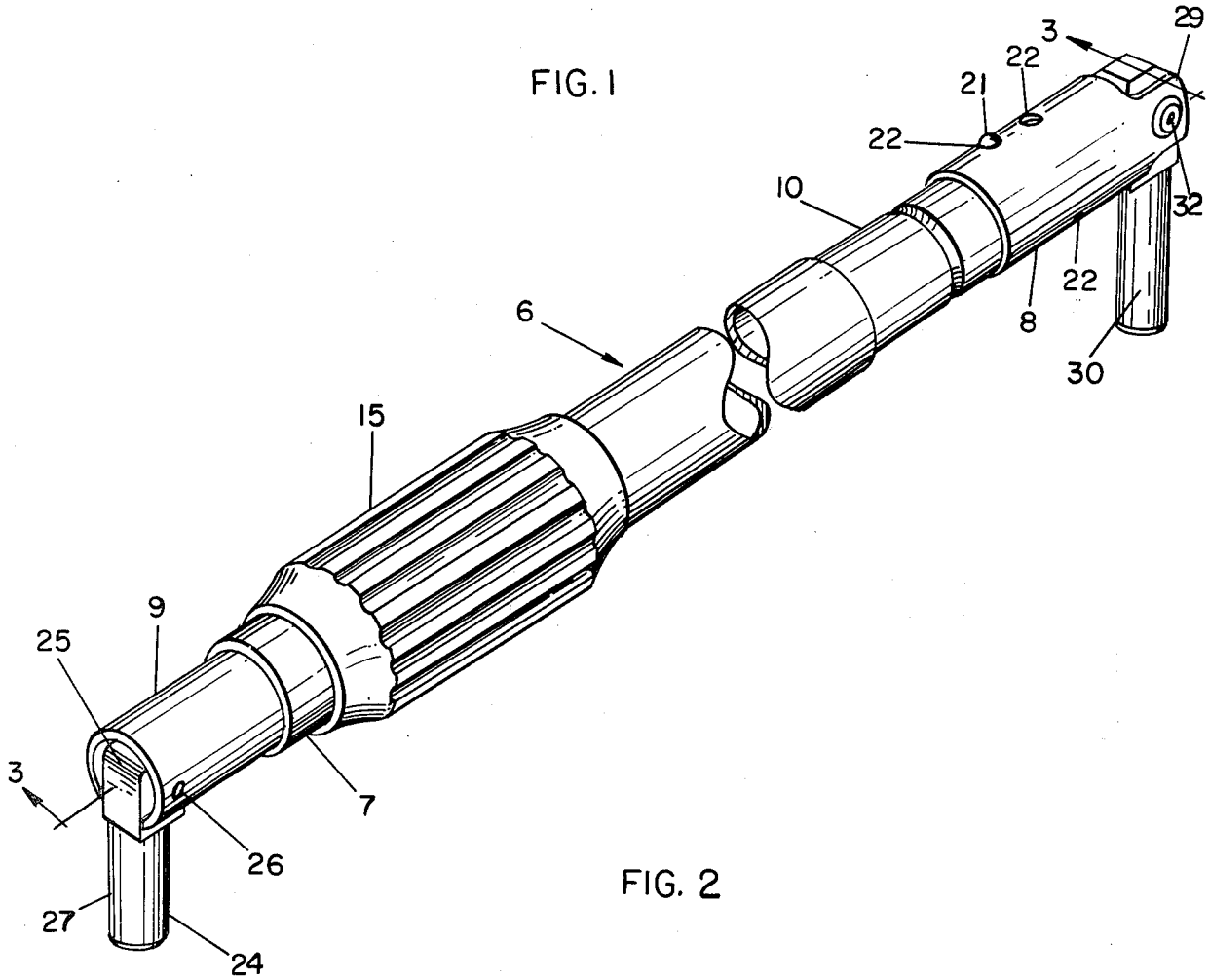
FIG. 2 is a perspective view, partly in section, of the device before installation.

Referring more particularly to the drawings, wherein similar reference characters designate like parts throughout the several views, numeral 1 generally identifies a sail boat having the usual open cockpit 2, rudder 4 depending from the stern 3 thereof, and a forwardly extending tiller 5 pivotally connected to the upper end of the rudder.

Figure 3:
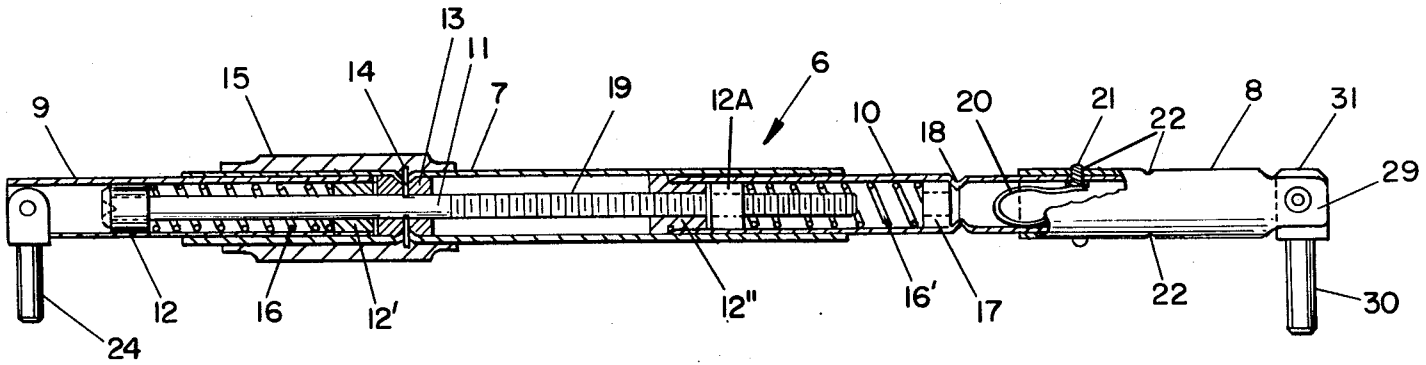
FIG. 3 is a section on the line 3—3 of FIG. 2.

As best shown in FIG. 3, the present tiller tender and holding device 6 includes two exterior, tubular, elongated, spaced apart sections 7 and 8, into the opposing inner ends of which are sleeved spaced apart, elongated, tubular interior sections 9 and 10. A rod 11 extends longitudinally in tubular sections 9 and 10 and has pistons 12 and 12A fixedly arranged on opposing ends thereof and snugly arranged therein by spaced tubular bearings 12' and 12''. Intermediate its ends, the rod 11 is formed with a spacer 13 having a locking pin 14 projecting therethrough to anchor the rod to exterior tubular section 7 and a control sleeve 15 arranged over section 7. Encircling the rod 11 at its opposing ends are loaded compression springs 16 and 16' which are interposed between spaced piston 12 and bearing 12' and 12'' and a sleeve 17 suitably fixedly mounted, as at 18, within interior section 10. Thus, the tiller tender and holding device functions generally as a solid bar to hold the rudder and vessel on a preset course. However, as the rod 11 is exteriorly treaded, as at 19, at its end projecting into interior section 10, it will be understood that small or fine lateral adjustment of the tiller and rudder to avoid floating debris and the like, or to compensate for the action of wind or currents, may be effected by the helmsman manually rotating control sleeve 15 in the appropriate direction. Such action will either draw sections 7 and 8 together to reduce the distance therebetween, or move the sections further apart to lengthen the rod, in an obvious manner. It will be noted that piston 12 is fixed to rod 11 so as to compress spring 16 against bearing 12' when the tiller 5 is pulled away from coaming 2. Piston 12A is threaded on rod 11 so as to compress spring 16 when the tiller is pushed toward the coaming, and the piston 12A is restrained from turning by the tension of spring 16 holding it firmly against bearing 12'', with the holding device 6 in its normal rest position, e.g., not being pushed or pulled. Thus, when the control sleeve 15 is rotated, to in turn rotate rod 11, the threads 19 on rod 11 will engage piston 12A and alter the total length of the device 6, in an obvious manner.

A detent button 21, suitably fixedly attached to the upper end of a flat curved spring 20 affixed to the inside wall of interior tubular section 10, is adapted to be lockably received in one of a series of spaced aligned apertures 22 in exterior section 8. Thus, the tiller tender and holding device may be readily shortened or lengthened, independently of adjustment of control sleeve 15, by depressing detent button 21 and longitudinally adjusting interior and exterior tubular sections 10 and 8 so that the detent is lockingly positioned in another of the spaced apertures 22.

Figure 5:
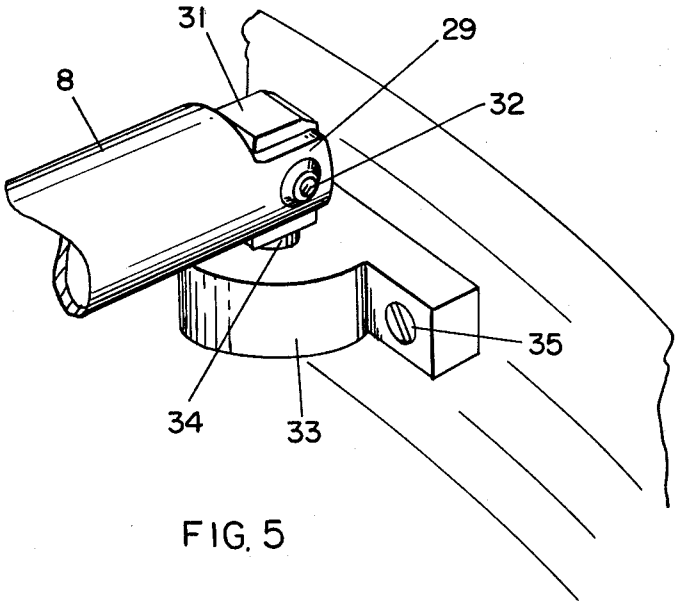
FIG. 5 is a perspective view of the coaming connecting pin and coaming socket.
Figure 4:
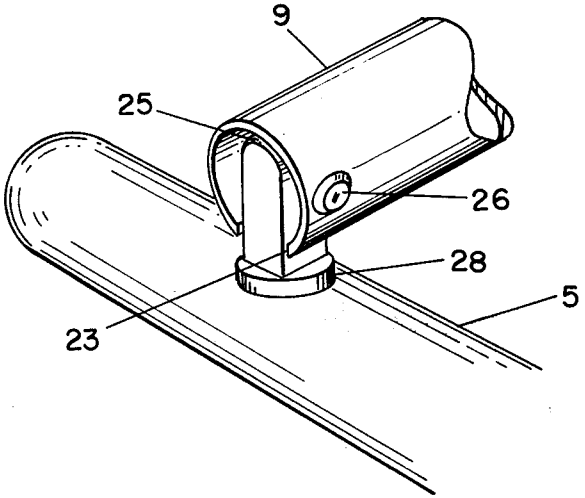
FIG. 4 is a perspective view of the tiller connecting pin and tiller socket.

The tiller tender and holding device 6 is removably interconnected at one end to tiller 5 by slotting the outer end of an exterior tubular section 9, as at 23, to receive the flattened, curved and rounded upper end 25 of a pin 24. The latter is pivoted to section 9, as at 26, so as to be arcuately moveable outwardly and upwardly through slot 23 and the open outer end of pin 24 engages the inner wall of section 9 and is stabilized thereby. The pin 24 has a reduced cylindrical lower end 27 which is adapted to interfit a vertically disposed bushing or socket 28 fixedly arranged in the inner end of tiller 5, as best shown in FIG. 4. The other end of the device is corresponding removably interconnected to a socket in the wall of cockpit 2 by forming the outer end of an exterior tubular section 8 with a pair of projecting ears 29 between which the enlarged and generally rectangular upper end 31 of a pin 30 is received and pivoted, as at 32. Pin 30 will thus arcuately pivot outwardly and upwardly and be receivable in a vertical bore 34 in a generally U-shaped socket member 33, suitably attached to the inner cockpit wall, as at 35, as best shown in FIG. 5.

From the foregoing, in the usual operative position, it will be apparent that the tiller tender and holding device 6 extends horizontally and transversely between the tiller and cockpit sockets 28–33. When so arranged, the tiller will be retained generally in the position of FIG. 1 so as to retain the sail boat on a generally straight course, but slight lateral swinging movements thereof caused by wind, current, and wave action can be corrected by physically moving the tiller laterally causing interior tubular sections 9–10 to sleeve inwardly or outwardly, in opposing directions, relative to exterior tubular sections 7–8 and against the tension of springs 16–16', with the latter serving to thereafter automatically return the tiller to its normal on course position. Thus, the tiller and vessel will be retained generally on course with minimum action by the helmsman. However, the latter may readily make necessary course changes as previously described.

The tiller tender and holding device may be entirely removed from both the tiller and cockpit holding sockets for storage, or only disconnected from the tiller socket, to permit of the usual manual control of the tiller. It will also be understood that the device may be disconnected from only the cockpit socket to enable employment as a tiller extension to facilitate manual control thereof, in an obvious manner.

While a preferred embodiment of tiller tending and holding device has been illustrated and described, it is to be understood that various changes and improvements may be made therein without departing from the scope and spirit of the appended claims.

What is claimed:

1. In a tiller tender and holding device for sail boats and the like, including a rudder with an inwardly projecting tiller, a transversely and generally horizontally disposed tubular connecting member interposed between an end of said tiller and a side wall of said sail boat, said member having downwardly disposed pins pivotally arranged in opposing ends thereof, and sockets in said tiller and side wall for removably receiving said pins whereby said tiller is retained in a generally longitudinally extending and neutral on course position, said member having sleeved tubular sections, threaded elongated screw rod means arranged in said sections, control sleeve means arranged on one of said tubular sections and fixedly connected to said screw rod means, a first piston means fixed on one end of said rod means, a second piston means threadedly arranged on said rod means in spaced relation to said first piston means, bearing means spacedly arranged on said rod means between said spaced piston means, spacer means fixedly arranged on said rod means intermediate said spaced bearing means with one of said tubular sections and said control sleeve means being anchored to said spacer means, and spring means arranged on said rod means whereby manual rotation of said control sleeve means rotates said rod means longitudinally and adjusts the length of said tubular connecting member and controls the lateral steering movement of said tiller.

2. In a tiller tender and holding device for sail boats and the like, as defined in claim 1, wherein said pins are removable from said sockets for storage, and one of said pins may be removed from its socket to permit of said member functioning as an extension of and for controlling lateral manual tiller adjustment thereof.

3. In a tiller tender and holding device for sail boats and the like, as defined in claim 1, wherein spring means is arranged on said screw rod whereby said tubular sections will telescope to allow limited tiller travel in either lateral direction and automatically return said tiller to original position when the tiller is released.

4. In a tiller tender and holding device for sail boats and the like, as defined in claim 1, wherein said sleeve means is exteriorly arranged on said member and is fixedly interconnected to said screw rod whereby manual rotation of said sleeve means adjusts the length of said rod and said tubular sections and lateral positioning of said tiller and rudder.

5. In a tiller tender and holding device for sail boats and the like, as defined in claim 1, wherein said tubular sections are sleeved one within the other, and one of said sections is adjustably interconnected to another section.

6. In a tiller tender and holding device for sail boats and the like, as defined in claim 5, wherein one of said tubular sections is spacedly apertured, and a tubular section sleevable therewithin has spring pressed detent means selectively receivable in said apertures for permitting extensive movement of said tubular sections and said tiller.

* * * * *